US010768565B2

(12) United States Patent
Iwasaki

(10) Patent No.: US 10,768,565 B2
(45) Date of Patent: Sep. 8, 2020

(54) IMAGE FORMING APPARATUS

(71) Applicant: Konica Minolta, Inc., Chiyoda-ku, Tokyo (JP)

(72) Inventor: Takahiro Iwasaki, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/424,222

(22) Filed: May 28, 2019

(65) Prior Publication Data

US 2019/0391518 A1 Dec. 26, 2019

(30) Foreign Application Priority Data

Jun. 20, 2018 (JP) ..... 2018-116584

(51) Int. Cl.
*G03G 15/00* (2006.01)
*G03G 15/16* (2006.01)

(52) U.S. Cl.
CPC ..... *G03G 15/505* (2013.01); *G03G 15/16* (2013.01); *G03G 15/5041* (2013.01)

(58) Field of Classification Search
None
See application file for complete search history.

(56) References Cited

U.S. PATENT DOCUMENTS

2018/0164737 A1* 6/2018 Iwasaki ..... G03G 21/12
2019/0187611 A1* 6/2019 Kawabata ..... G03G 15/0258

FOREIGN PATENT DOCUMENTS

JP 2013-160843 A 8/2013

* cited by examiner

*Primary Examiner* — Roy Y Yi
(74) *Attorney, Agent, or Firm* — Squire Patton Boggs (US) LLP

(57) ABSTRACT

An image forming apparatus including: a cyclone which centrifugally separates toner from air containing the toner scattered; a storage which stores the toner separated by the cyclone; a filtering portion which allows air to pass, the air being obtained after the toner is separated by the cyclone; a duct which guides the air that passes through the filtering portion; a fan which generates a flow of the air to discharge the air that passes through the filtering portion; and a hardware processor which measures a rotational speed of the fan, detects a full state in which the storage is filled with the toner based on change of the rotational speed of the fan, and issues a warning in a case in which a variation rate of rotational speeds of the fan measured a plurality of times is a predetermined value or more.

11 Claims, 9 Drawing Sheets

| MEASURING TIME (SECOND) | NUMBER OF OUTPUT PULSES | 1 PULSE DETECTION ERROR |
|---|---|---|
| 1 | 293 | 0.34% |
| 2 | 587 | 0.17% |
| 5 | 1467 | 0.07% |
| 10 | 2933 | 0.03% |
| 20 | 5867 | 0.02% |

IMAGE FORMING APPARATUS

CROSS-REFERENCE

This application claims priority to Japanese Application No. JP 2018-116584 filed on Jun. 20, 2018, and is incorporated verbatim herein by reference in its entirety, including the specification, drawings and the claims.

BACKGROUND

Technological Field

The present invention relates to an image forming apparatus.

Description of the Related Art

Conventionally, an electrophotographic image forming apparatus that forms an image on paper by use of toner has been known. As such an image forming apparatus, an image forming apparatus including a toner collector that sucks scattered toner generated in a developing part, centrifugally separates the toner by a cyclone to recover the separated toner in a storage, and collects, by a filter, toner which cannot be centrifugally separated (for example, refer to Japanese Patent Laid-Open No. 2013-160843). When the storage is filled with the toner and is brought into a full state, the toner swirls up to cause clogging in the filter. As a result, the toner scatters in the image forming apparatus, and therefore in the aforementioned Japanese Patent Laid-Open No. 2013-160843, an optical sensor that detects clogging of the filter is mounted, and when clogging is detected by this sensor, a flow rate of air in the toner collector is adjusted.

The scattering of toner cannot be appropriately suppressed after the clogging of the filter occurs, and therefore an image forming apparatus that detects a full state of a storage based on change of a rotational speed of a fan before clogging of a filter occurs, and suppresses scattering of toner inside the apparatus is proposed.

However, in assembly or cleaning and maintenance of the image forming apparatus, when a unit including a cyclone or a duct is assembled or detached, in a case in which a clearance is formed in the duct, the rotational speed of the fan is not stabilized, and therefore there is a problem that the full state (usage limit of a cyclone unit) of the storage is erroneously detected. In particularly, the duct on the downstream side of the cyclone unit is often disposed on the back side of the apparatus, and the clearance of the duct is unlikely to be visually confirmed, and therefore even when the assembly state is abnormal, such abnormality is sometimes overlooked.

SUMMARY

The present invention has been made to solve such a problem, and an object of the present invention is to prevent erroneous detection of a full state of a storage that stores toner.

To achieve at least one of the abovementioned objects, according to an aspect of the present invention, an image forming apparatus reflecting one aspect of the present invention including: a cyclone which centrifugally separates toner from air containing the toner scattered; a storage which stores the toner separated by the cyclone; a filtering portion which allows air to pass, the air being obtained after the toner is separated by the cyclone; a duct which guides the air that passes through the filtering portion; a fan which generates a flow of the air to discharge the air that passes through the filtering portion; and a hardware processor which measures a rotational speed of the fan, detects a full state in which the storage is filled with the toner based on change of the rotational speed of the fan, and issues a warning in a case in which a variation rate of rotational speeds of the fan measured a plurality of times is a predetermined value or more.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
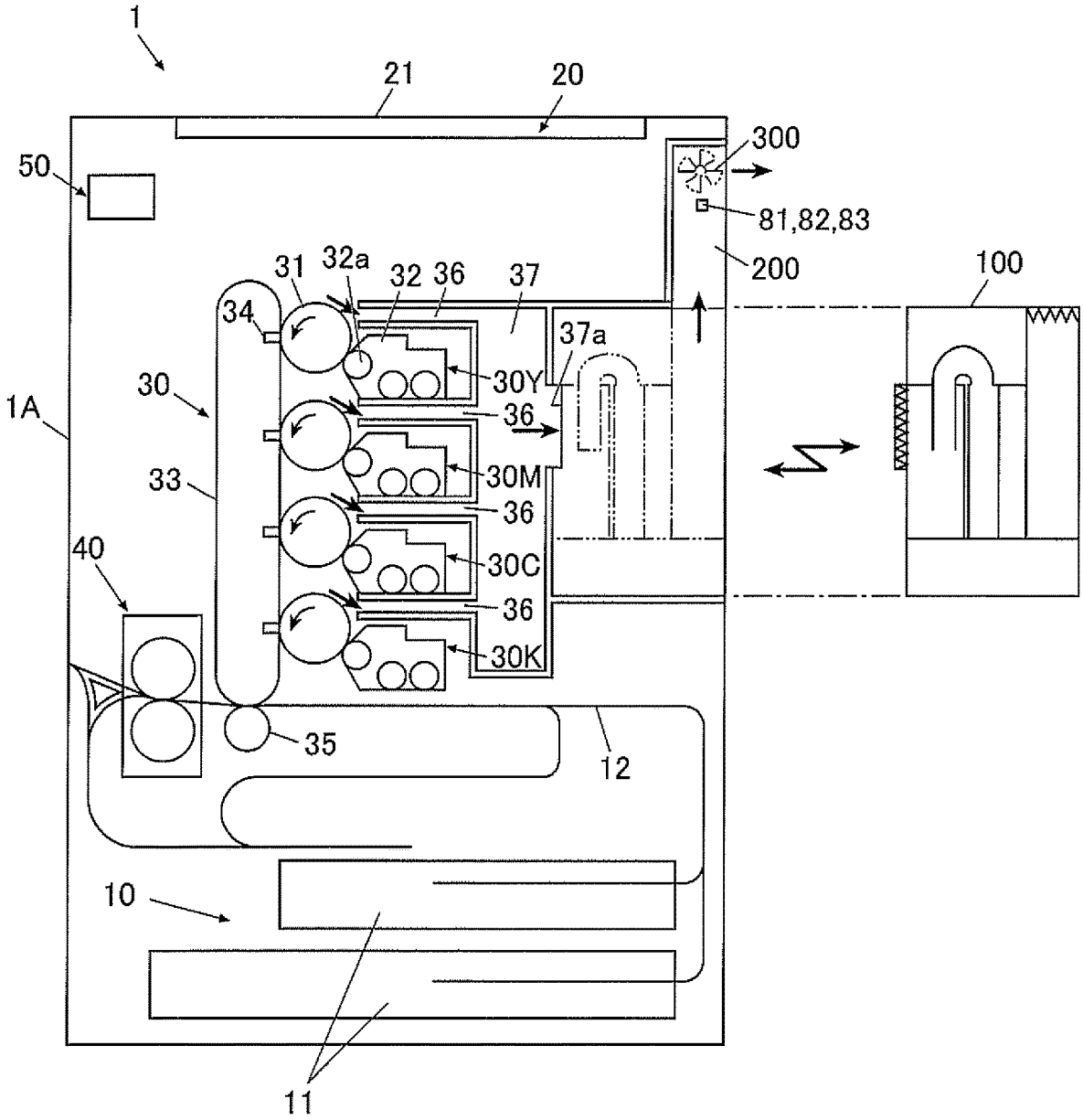
FIG. 1 is a schematic diagram illustrating an entire configuration of an image forming apparatus in an embodiment of the present invention.
Figure 2:
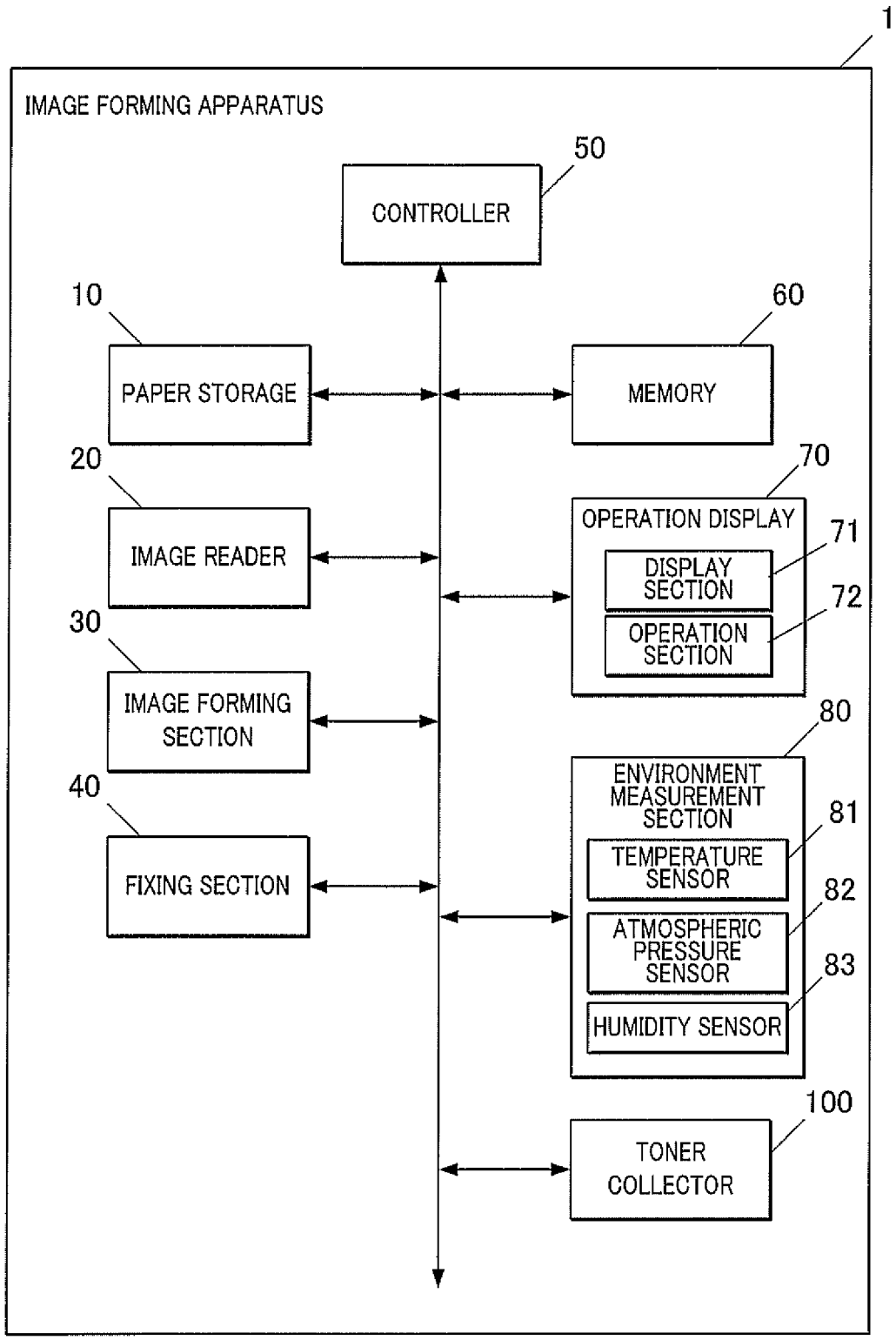
FIG. 2 is a block diagram illustrating a functional configuration of the image forming apparatus.

FIG. 1 is a schematic diagram illustrating an entire configuration of an image forming apparatus 1 in an embodiment of the present invention. FIG. 2 is a block diagram illustrating a functional configuration of the image forming apparatus 1.

The image forming apparatus 1 forms an image on paper by an electrophotographic system, and is a tandem type color image forming apparatus that overlaps toners of four colors of yellow (Y), magenta (M), cyan (C), and black (K).

The image forming apparatus 1 has a substantially rectangular parallelepiped apparatus body 1A that forms an exterior, and a paper storage 10, an image reader 20, an image forming section 30, a fixing section 40, a controller 50, a memory 60, an operation display 70, an environment measurement section 80, and a toner collector 100 are provided in this apparatus body 1A.

The paper storage 10 is disposed in a lower part of the image forming apparatus 1, and a plurality of trays 11 according to the size and the kind of paper are provided. The paper is fed from each tray 11 to be sent to a conveyor 12, and is conveyed to the image forming section 30 and the fixing section 40 by the conveyor 12.

The image reader 20 reads an image of an original conveyed by an original conveyor (not illustrated), or an image of an original placed on an original platen 21, and generates image data. The image reader 20 applies processes such as shading compensation, a dither process, and compression to image data created by A/D conversion, and the image data is stored in a RAM (not illustrated) of the controller 50 described below.

The image data is not limited to data output from the image reader 20, but may be data received from an external apparatus such as a personal computer and other image forming apparatus connected to the image forming apparatus 1.

The image forming section 30 performs image formation on paper based on an image forming job.

The image forming section 30 includes four sets of image forming units 30Y, 30M, 30C, 30K corresponding to respective color components of Y, M, C and K, an intermediate transfer belt 33, primary transfer portions 34, and a secondary transfer roller 35.

Each of the image forming units 30Y, 30M, 30C, 30K has a drum-like photoreceptor 31, a developing portion 32 disposed around this photoreceptor 31, a charging portion, an exposing portion, a cleaner (not illustrated), and the like.

The exposing portion forms an electrostatic latent image on the photoreceptor 31 by irradiating the photoreceptor 31 having a surface charged by the charging portion with a laser beam, and exposing the photoreceptor 31. The developing portion 32 feeds toner of a predetermined color (any of Y, M, C and K) onto the exposed photoreceptor 31 by a developing roller 32*a*, and develops the electrostatic latent image formed on the photoreceptor 31.

Images (monochrome images) formed on the four respective photoreceptors 31 corresponding to Y, M, C and K by respective toners of Y, M, C and K are transferred from the respective photoreceptors 31 to the intermediate transfer belt 33. The intermediate transfer belt 33 is an endless belt wound around a plurality of conveying rollers, and rotates in accordance with rotation of each conveying roller.

At positions facing the respective photoreceptors 31 of the image forming units 30Y, 30M, 30C, 30K on an inner peripheral side of the intermediate transfer belt 33, the primary transfer portions 34 are provided. These primary transfer portions 34 transfer the toners adhered onto the photoreceptors 31 to the intermediate transfer belt 33 by applying voltages having polarities opposite to the toners to the intermediate transfer belt 33.

Then, the intermediate transfer belt 33 rotationally drive, so that respective toner images formed by the four image forming units 30Y, 30M, 30C, 30K are successively transferred onto a surface of the intermediate transfer belt 33. That is, on the intermediate transfer belt 33, the toner images whose color components are Y, M, C and K overlap each other, and a color image is formed.

The secondary transfer roller 35 is disposed at a facing position on an outer peripheral side of the intermediate transfer belt 33. A nip part where this secondary transfer roller 35 is in contact with the intermediate transfer belt 33 is a transfer position, and the secondary transfer roller 35 brings paper conveyed by the conveyor 12 into contact with the intermediate transfer belt 33, and transfers the toner image formed on an outer peripheral surface of the intermediate transfer belt 33 to the paper.

On a paper discharge side of the secondary transfer roller 35, the fixing section 40 is provided.

The fixing section 40 includes a pair of rollers composed of a heating roller and a pressure roller. The paper passes through the nip part of the pair of rollers, so that heat and pressure are applied to the paper, and the toner image transferred on the paper is melted and fixed.

Respective suction ducts 36 are disposed on upper sides of the respective developing portions 32 of the four image forming units 30Y, 30M, 30C, 30K. That is, the four suction ducts 36 are provided corresponding to the four image forming units 30Y, 30M, 30C, 30K. Toner-containing air that contains toner scattered in each of the corresponding image forming units 30Y, 30M, 30C, 30K passes through the suction duct 36.

The four suction ducts 36 are each connected to a common duct 37. The common duct 37 is formed in a vertically extending hollow rectangular parallelepiped shape, and has a role as a receiving portion for detachably attaching the toner collector 100 (below described in detail), and a role of guiding the toner-containing air from the four suction ducts 36 to the toner collector 100.

On a side, facing the four image forming units 30Y, 30M, 30C, 30K, of the common duct 37, four communication ports (not illustrated) capable of connecting the suction ducts 36 are provided. On the other hand, a connection port 37*a* for connecting an inflow port 101 (refer to FIG. 3) of the toner collector 100 is provided in a surface on a side opposite to the side, facing the four image forming units 30Y, 30M, 30C, 30K, of the common duct 37.

A duct 200 that guides air which passes through the toner collector 100 is connected to the toner collector 100. A fan 300 is disposed on a side, opposite to the toner collector 100, of the duct 200. The fan 300 generates a flow of air discharged from the common duct 37 to the outside of the image forming apparatus 1 through the toner collector 100 and the duct 200. More specifically, air that flows from the common duct 37 into the toner collector 100 flows out of an outflow port 106 (refer to FIG. 3), and thereafter passes through the duct 200 and the fan 300 to be discharged to the outside of the image forming apparatus 1. In FIG. 1, the shapes, the installation positions, and the like of the toner collector 100, the duct 200 and the fan 300 are simplified.

The fan 300 outputs a pulse signal for calculating a rotational speed (rotation number per unit time) to the controller 50.

The controller 50 is composed of a CPU (Central Processing Unit), a RAM (Random Access Memory), and the like. The CPU of the controller 50 reads out various programs such as a system program, a processing program, and the like stored in the memory 60, and develops the programs in the RAM, and performs various processes in accordance with the developed programs.

The memory 60 is composed of an HDD (Hard Disk Drive), a non-volatile semiconductor memory, or the like.

Various programs including the system program and the processing program performed by the controller 50, and data necessary for performing these programs are stored in the memory 60.

The operation display 70 includes a display screen, and includes a display section 71 that displays various information on a screen, and an operation section 72 used for input of various instructions by a user.

The environment measurement section 80 measures an environmental condition when image formation is performed by the image forming apparatus 1. More specifically, the environment measurement section 80 includes a temperature sensor 81, an atmospheric pressure sensor 82, and a humidity sensor 83. The environment measurement section 80 outputs a detection signal pertaining to a temperature detected by the temperature sensor 81 to the controller 50, outputs a detection signal pertaining to atmospheric pressure detected by the atmospheric pressure sensor 82 to the controller 50, and outputs a detection signal pertaining to humidity detected by the humidity sensor 83 to the controller 50.

The temperature sensor 81, the atmospheric pressure sensor 82, and the humidity sensor 83 are disposed at such positions that change of the density of air which passes through the fan 300 can be measured.

Now, the toner collector 100 and the duct 200 will be described with reference to FIG. 3.

Figure 3:
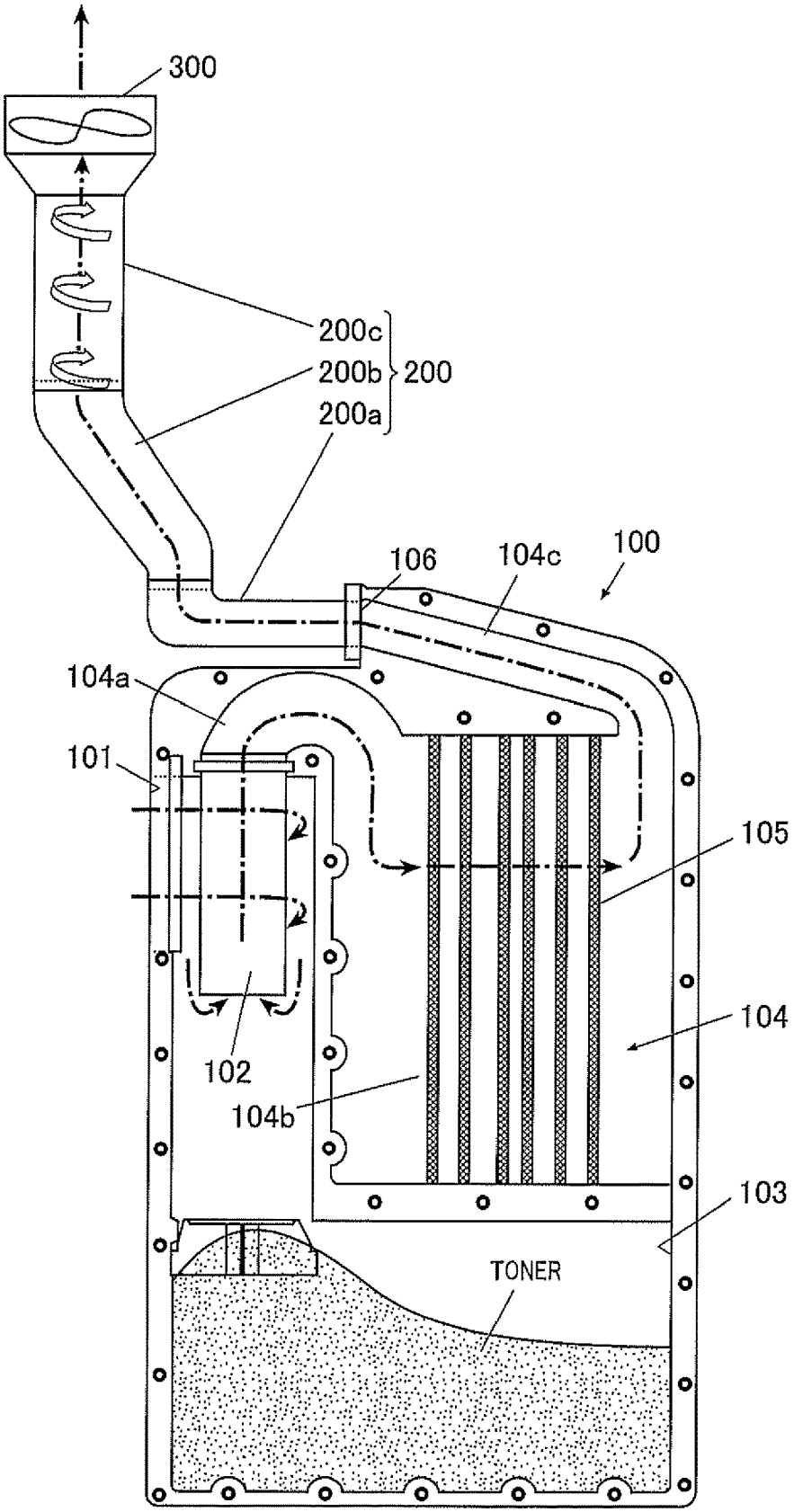
FIG. 3 is a diagram schematically illustrating a toner collector and a duct.

FIG. 3 is a diagram schematically illustrating the toner collector 100 and the duct 200. In FIG. 3, a flow of air is schematically illustrated by a dashed line.

As illustrated in FIG. 3, the outer shape of the toner collector 100 (cyclone unit) is formed in a substantially rectangular parallelepiped shape, and is configured so as to be detachably attached to the common duct 37 of the apparatus body 1A. The toner collector 100 includes the inflow port 101, a cyclone 102, a storage 103, an air flow passage 104, a filtering portion 105, and the outflow port 106.

The inflow port 101 is a receiving port that receives toner-containing air that passes through the common duct 37.

When the toner collector 100 is mounted on the common duct 37, the inflow port 101 faces the connection port 37*a* of the common duct 37. Consequently, the cyclone 102 is communicated with an internal space of the common duct 37 through the inflow port 101.

The cyclone 102 centrifugally separates toner from toner-containing air that passes through the common duct 37 to flow therein through the inflow port 101. The cyclone 102 is cylindrically formed, and the axial direction coincides with the vertical direction (direction in which gravity acts). Thus, arrangement in which the axial direction coincides with the vertical direction is optimum arrangement for separation of toner from toner-containing air.

The toner-containing air that flows into the cyclone 102 advances in the tangential direction of an inner periphery of the cyclone 102. Consequently, a swirl flow formed by swirling of air is generated inside the cyclone 102.

Toner in the swirl flow radially moves by centrifugal force that acts by circular movement of an object, and therefore most of the toner separates (centrifugally separates) from air. The separated toner falls downward by its own weight, and is stored in the storage 103. On the other hand, the air flows into the cyclone 102 from a lower end side of a cylindrical portion of the cyclone 102, and enters an inflow portion 104*a* of the air flow passage 104 provided on an upper side of the cyclone 102.

The air flow passage 104 includes the inflow portion 104*a* that communicates with the cyclone 102, a filter installation portion 104*b* that communicates with the inflow portion 104*a*, and an outflow portion 104*c* that communicates with the filter installation portion 104*b*.

The inflow portion 104*a* is formed in a U-shaped pipe shape, and inverts air, which flows therein from the cyclone 102, upside down, and guides the inverted air to the filter installation portion 104*b*.

The filtering portion 105 that filters toner is disposed in the filter installation portion 104*b*.

The filtering portion 105 collects little toner contained in the air that passes through the cyclone 102. Consequently, the air that passes through the filtering portion 105 is cleaned.

When a plurality of filters are disposed so as to overlap on each other in the direction in which the air passes, an air cleaning effect is increased, and therefore such filtering portion 105 is preferable. For example, in the filtering portion 105, a toner dustproof filter, an ozone catalytic filter, and the like are arranged in predetermined arrangement.

The air that passes through the filtering portion 105 in the filter installation portion 104*b* flows into the outflow portion 104*c* provided on an upper side of the filter installation portion 104*b*, and flows out on the fan 300 (duct 200) side from the outflow port 106 formed on the air flow direction downstream side (opposite side to the cyclone 102) of this outflow portion 104*c*.

Thus, the air sucked by each suction duct 36 passes through the common duct 37, the inflow port 101, the cyclone 102, the inflow portion 104*a*, the filter installation portion 104*b* (filtering portion 105), the outflow portion 104*c*, and the outflow port 106, and thereafter passes through the duct 200 and the fan 300 to be discharged to the outside of the image forming apparatus 1.

The duct 200 guides the air that passes through the filtering portion 105 to the outside. The duct 200 is configured by connecting a plurality of duct components 200*a*, 200*b*, 200*c*. The fan 300 is disposed on the downstream side with respect to the duct component 200*c* located on the most downstream side in the plurality of duct components 200*a*, 200*b*, 200*c*. Depending on respective mounting states of the duct components 200*a*, 200*b*, 200*c*, and the toner collector 100, clearances can be formed in connecting parts of the duct components 200*a*, 200*b*, 200*c* (between the duct components), between the duct component 200*a* and the toner collector 100, and between the duct component 200*c* and the fan 300.

When the air enters from the clearance of the duct 200, a turbulent flow generates in the duct 200. The flow rate of the air that passes through the fan 300 varies by generation of the turbulent flow in the duct 200. A variation rate of the rotational speeds of the fan 300 is increased by the variation of the flow rate of the air that passes through the fan 300.

For example, in assembly or cleaning and maintenance of the image forming apparatus 1, when the toner collector 100 (cyclone unit) and the duct 200 are assembled or detached, a clearance is formed in the duct 200, so that the variation rate of the rotational speeds of the fan 300 is increased.

In the image forming apparatus 1 including a toner suction mechanism using the cyclone 102, the wind speed is faster compared to an apparatus that does not include the cyclone, and the faster the wind speed is, the more easily the influence of a turbulent flow is received, and therefore the variation rate of the rotational speeds of the fan 300 is increased.

The toner collector 100 is formed integrally with the cyclone 102, the storage 103, and the filtering portion 105. For example, in a case in which the storage 103 is brought into a full state in which toner is filled, theses cyclone 102, storage 103, and filtering portion 105 are integrally replaceable.

<Rotational Speed Measurement Process>

Now, a rotational speed measurement process will be described.

The controller 50 measures the rotational speed (rotation number per unit time) of the fan 300 based on a pulse signal output from the fan 300 in accordance with a rotational speed measurement program.

When the rotational speed of the fan 300 is measured, the number of rotations of the fan 300 during a predetermined measuring time is detected, the rotational speed is calculated based on the detected rotation number and the measuring time. However, this measuring time is desirably a predetermined time or more. That is, the controller 50 measures the number of rotations of the fan 300 for the predetermined time or more, so that the rotational speed of the fan 300 is calculated.

Figures 4A, 4B:
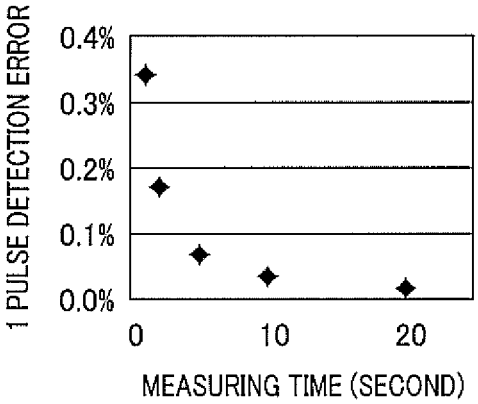
FIG. 4A is a diagram illustrating the number of output pulses of a fan and a detection error of 1 pulse with respect to a measuring time.
FIG. 4B is a graph obtained by plotting the detection error of 1 pulse with respect to the measuring time.

FIG. 4A illustrates the number of output pulses of a fan with respect to a measuring time, and a detection error of 1 pulse, in a case in which a fan that outputs 2 pulses per rotation is used, and a rotational speed of 8800 [rpm] is detected. The detection error of 1 pulse is a ratio of 1 pulse to the number of output pulses detected within the measuring time. FIG. 4B is a graph obtained by plotting the detection error of 1 pulse with respect to the measuring time. For example, the measuring time is set to 10 seconds or more, so that the detection error of 1 pulse can be suppressed to 0.03% or less. The measuring time is set to 20 seconds or more, so that the detection error of 1 pulse can be suppressed to 0.02% or less.

<Full State Detection Process>

Now, a full state detection process will be described.

Figure 5A:
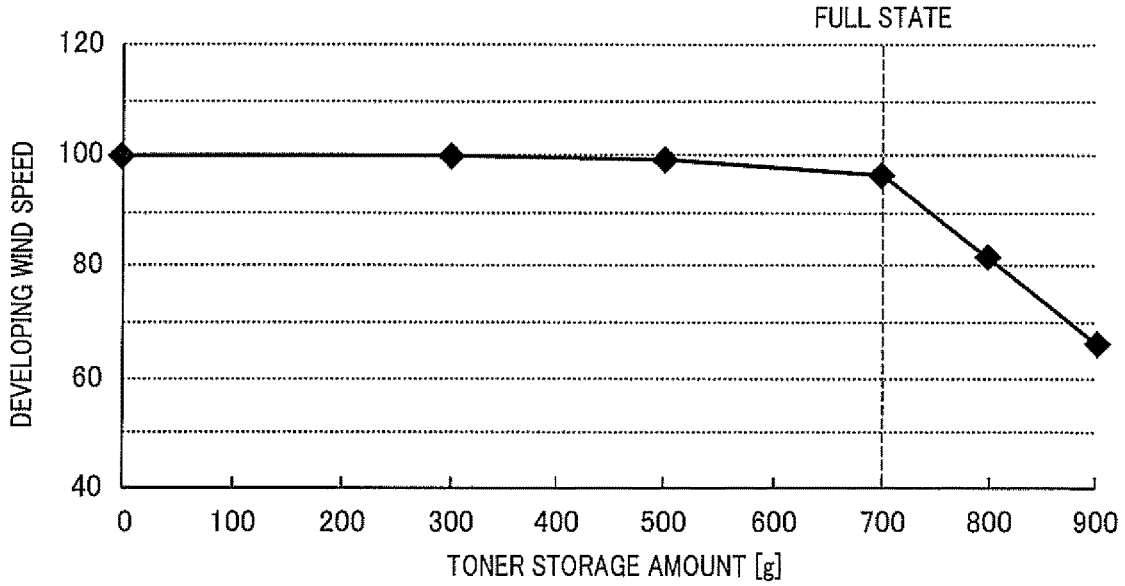
FIG. 5A is a diagram illustrating correspondence relation between a toner storage amount and a developing wind speed.
Figure 5B:
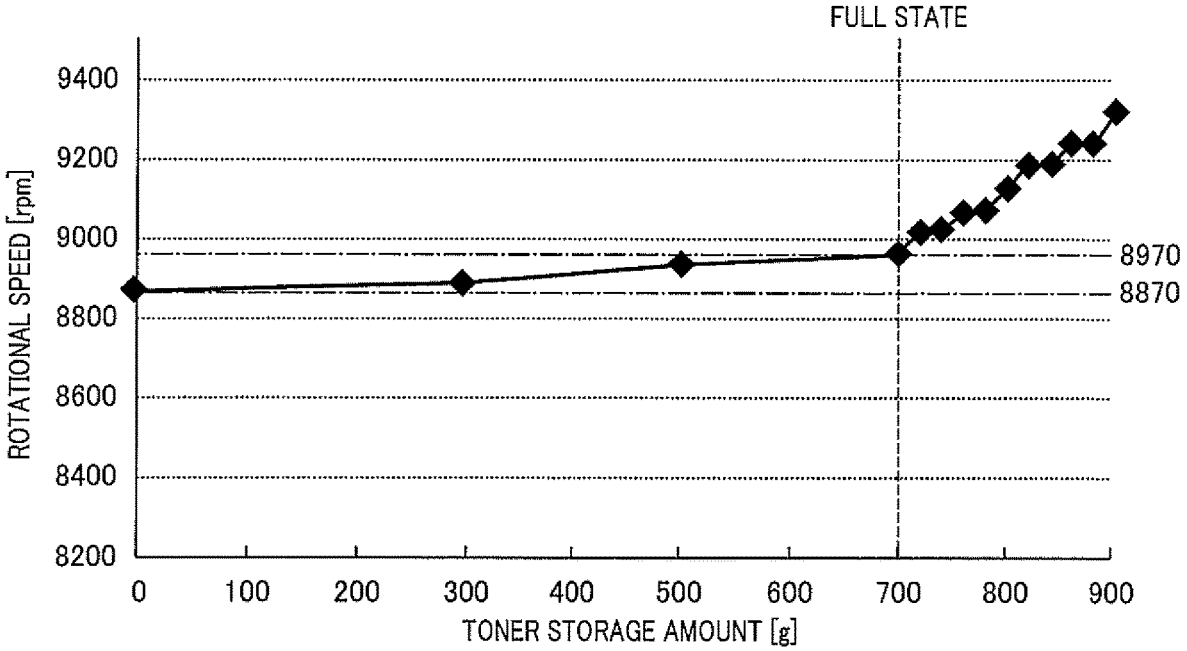
FIG. 5B is a diagram illustrating correspondence relation between a toner storage amount and the rotational speed of the fan.

FIG. 5A is a diagram illustrating correspondence relation between a toner storage amount and a developing wind speed, and FIG. 5B is a diagram illustrating correspondence relation between a toner storage amount and the rotational speed of the fan 300.

Herein, in FIG. 5A and FIG. 5B, under the conditions of a temperature of 20° C., humidity of 50%, atmospheric pressure of 1002 hPa, the rotational speed of the fan 300 is set such that a ratio of toner stored in the storage 103 and recovered, in toner-containing air (separation efficiency of toner of the cyclone 102) is 98%. That is, 2% of the toner in the toner-containing air is not stored in the storage 103, and are collected (filtered) by the filtering portion 105.

The full state in which the storage 103 is filled with toner is set to 700[g]. However, this is an example, and the full state is not limited to this, and can be appropriately and arbitrarily changed. In FIG. 5A, the wind speed (developing wind speed) of the air (toner-containing air) that passes through each suction duct 36 is a speed obtained by normalizing a wind speed in the state of the toner storage amount 0 [g] as 100.

As illustrated in FIG. 5A, when the separation efficiency of the toner in the cyclone 102 is high, clogging of the filtering portion 105 is unlikely to occur, and therefore the developing wind speed is unlikely to be lowered until the storage 103 is brought into the full state of being filled with toner.

However, when the storage 103 is filled with the toner to be brought into the full state, the toner in the storage 103 swirls up, and clogging occurs in the filtering portion 105. As a result, the developing wind speed is reduced, and the toner in the image forming apparatus 1 scatters. Therefore, in order to suppress the scattering of the toner into the image forming apparatus 1, the clogging of the filtering portion 105 caused after the storage 103 is brought into the full state is not detected by the sensor, but the full state of the storage 103 needs to be detected before the clogging of the filtering portion 105 occurs.

As illustrated in FIG. 5B, in a state in which the separation efficiency of the toner in the cyclone 102 is set to 98%, the rotational speed of the fan 300 in a new article state before image formation is performed by the image forming apparatus 1 is 8870 [rpm].

When the image formation is started by the image forming apparatus 1, toner is stored in the storage 103, and toner is collected by the filtering portion 105, the flow rate of the air that passes through the fan 300 is reduced, and therefore the rotational speed of the fan 300 that drives at a predetermined voltage is increased with reduction of a rotation load. Then, the rotational speed of the fan 300 in the full state in which the storage 103 is filled with toner becomes 8970 [rpm]. After the storage 103 is brought into the full state, the toner in the storage 103 swirls up, and clogging occurs in the filtering portion 105, and the rotational speed of the fan 300 rapidly increases.

That is, the rotational speed of the fan 300 in the full state of the storage 103 is slightly faster than the rotational speed of the fan 300 in the new article state by 100 [rpm], about 1.1%. Therefore, high accuracy is required in order to detect the full state of the storage 103 from change of the rotational speed of the fan 300, and particularly, it is considered that a physical property of air (for example, the density of air) that passes through the fan 300 needs to be considered. Correction of the rotational speed of the fan 300 will be described below.

The controller 50 detects the full state in which the storage 103 is filled with toner, based on the change of the rotational speed of the fan 300 in accordance with a full state detection program.

For example, as illustrated in FIG. 5B, in a case in which under the conditions of a temperature of 20° C., humidity of 50%, and atmospheric pressure of 1002 hPa, the rotational speed (8870 [rpm]) of the fan 300 in the new article state before the image formation is performed by the image forming apparatus 1 is used as a reference rotational speed, the rotational speed of the fan 300 becomes faster than this reference rotational speed by about 1.1% (for example, the rotational speed of the fan 300 is changed from 8870 [rpm] to 8970 [rpm]), it is detected that the storage 103 is in the full state filled with toner.

<Duct Clearance Detection Process>

Now, a duct clearance detection process will be described.

In a case in which the variation rate of the rotational speeds of the fan 300 measured a plurality of times is a predetermined value (reference variation rate) or more, the controller 50 determines that a clearance is formed in the duct, and issues a warning, in accordance with a duct clearance detection program. Also in this duct clearance detection process, the controller 50 uses the rotational speed of the fan 300 after correction in accordance with the change of an environmental condition.

Figure 6A:
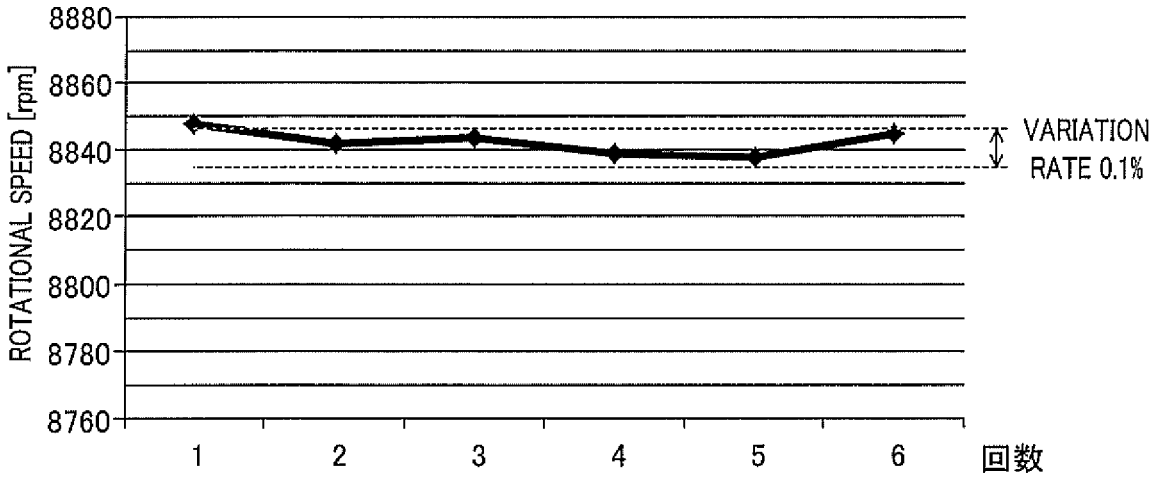
FIG. 6A is a variation example of the rotational speed of the fan, measured in a state in which no clearance exists in the duct.

FIG. 6A illustrates a variation example of the rotational speed of the fan 300, measured a plurality of times in a state in which no clearance exists in the duct 200. The controller 50 obtains a variation rate F of the rotational speeds of the fan 300 in accordance with the following Expression (1).

[Expression 1]

$$F = \frac{3 \times \sigma \times 100}{A} \quad \text{Expression (1)}$$

where reference symbol σ denotes a standard deviation of the rotational speed of the fan 300 obtained by a plurality of times of measurements, and reference symbol A denotes an average value of the rotational speed of the fan 300 obtained by a plurality of times of measurements.

In a state in which any clearance does not exist in the duct 200, the variation rate F of the rotational speeds of the fan 300 is stabilized at about 0.1%.

Figure 6B:
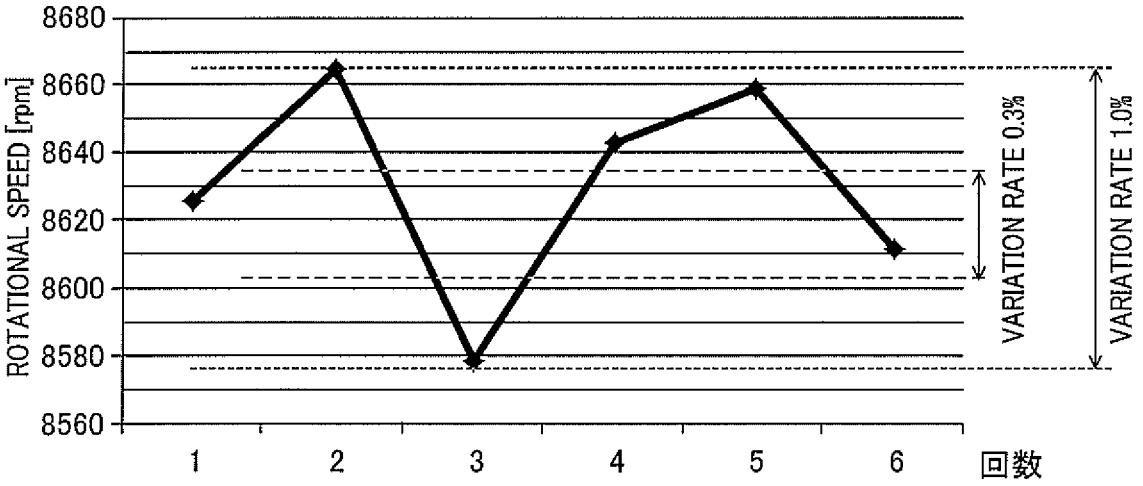
FIG. 6B is a variation example of the rotational speed of the fan, measured in a state in which a clearance exists in the duct.

FIG. 6B illustrates a variation example of the rotational speed of the fan 300, measured a plurality of times in a state in which a clearance exists in the duct 200. The clearance at this time was 0.2 [mm]. In a case in which the clearance exists in the duct 200, the rotational speed of the fan 300 is not stabilized, and the variation rate of the rotational speeds of the fan 300 is increase up to about 1.0%. When the variation rate is thus increased, the full state of the storage 103 may be erroneously detected, and therefore a warning needs to be issued before the above state.

For example, in a case in which the variation rate of the rotational speeds of the fan 300, measured 6 times becomes 0.3% or more, the controller 50 displays a warning on the display section 71.

<Fan Rotational Speed Correction Process>

Now, a fan rotational speed correction process will be described. The rotational speed of the fan 300 changes in accordance with the temperature, the atmospheric pressure, the humidity, and the like.

The rotational speed co [rpm] of the fan 300 is expressed by the following Expression (2).

[Expression 2]

$$\omega = C \times (T + 273.15)^{\frac{1}{3}} \quad \text{Expression (2)}$$

where reference symbol C denotes a correction coefficient, and reference symbol T denotes a temperature.

The correction coefficient C is calculated in accordance with the following Expression (3).

[Expression 3]

$$C = \left(\frac{W \cdot R}{k \cdot P}\left(1013 - \frac{11}{29} P_{W0}(T) \cdot RH\right)\right)^{\frac{1}{3}} \quad \text{Expression (3)}$$

where reference symbol W denotes power consumption of the fan 300, reference symbol k denotes a constant that changes by the resistance of the fan 300 or the like, reference symbol R denotes a gas constant, reference symbol P denotes atmospheric pressure, reference symbol $P_{W0}(T)$ denotes saturated water vapor pressure, and reference symbol RH denotes relative humidity.

The influence of the physical property of air on the rotational speed of the fan 300 will be described with reference to FIG. 7.

Figure 7:
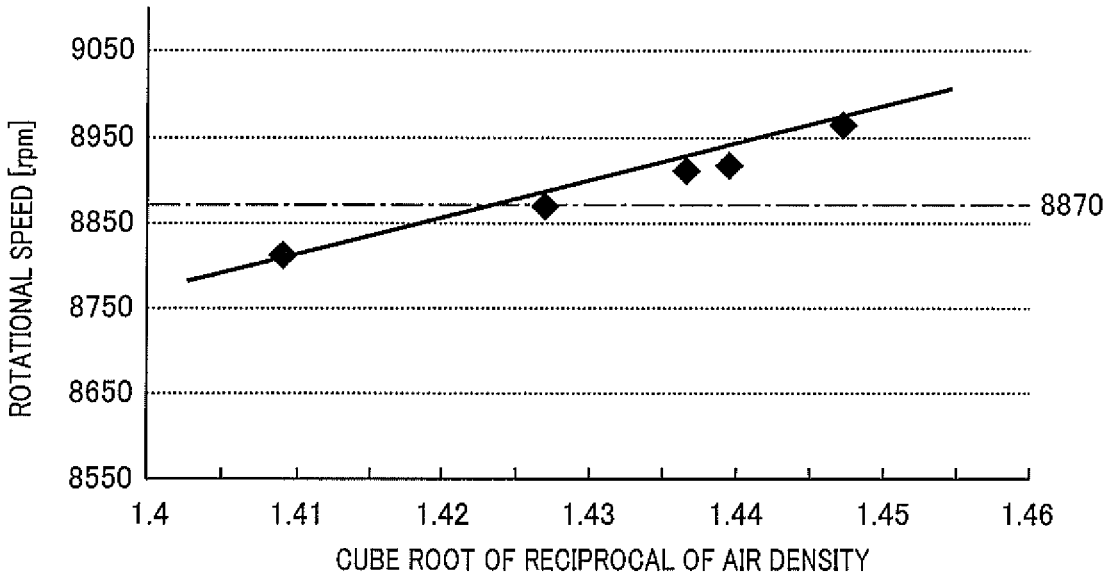
FIG. 7 is a diagram illustrating correspondence relation between the cube root of the reciprocal of the density of air, and the rotational speed of the fan.

FIG. 7 is a diagram illustrating correspondence relation between the cube root of the reciprocal of the density of air, and the rotational speed of the fan 300.

More specifically, FIG. 7 illustrates a measurement result of the rotational speed of the fan 300 in a case in which the density of air is changed by adjustment of the temperature under the conditions of humidity of 50%, and atmospheric pressure of 1002 hPa. In a range of the environment illustrated in FIG. 7, the relation between the cube root of the reciprocal of the density of air, and the rotational speed of the fan 300 is approximated by a straight line (linear function).

The fan 300 is a fan in the new article state before the image formation is performed by the image forming apparatus 1.

As illustrated in FIG. 7, as the density of air is reduced (as the cube root of the reciprocal of the density of air is increased), the rotational speed of the fan 300 that drives at a predetermined voltage is increased with reduction of the rotation load.

Herein, the density of air is changed by, for example, the temperature, the atmospheric pressure, the humidity, and the like, and therefore the influence of each of the temperature, the atmospheric pressure, and the humidity on the rotational speed of the fan 300 is discussed as follows.

First, the influence of the temperature on the rotational speed of the fan 300 will be described with reference to FIG. 8.

Figure 8:
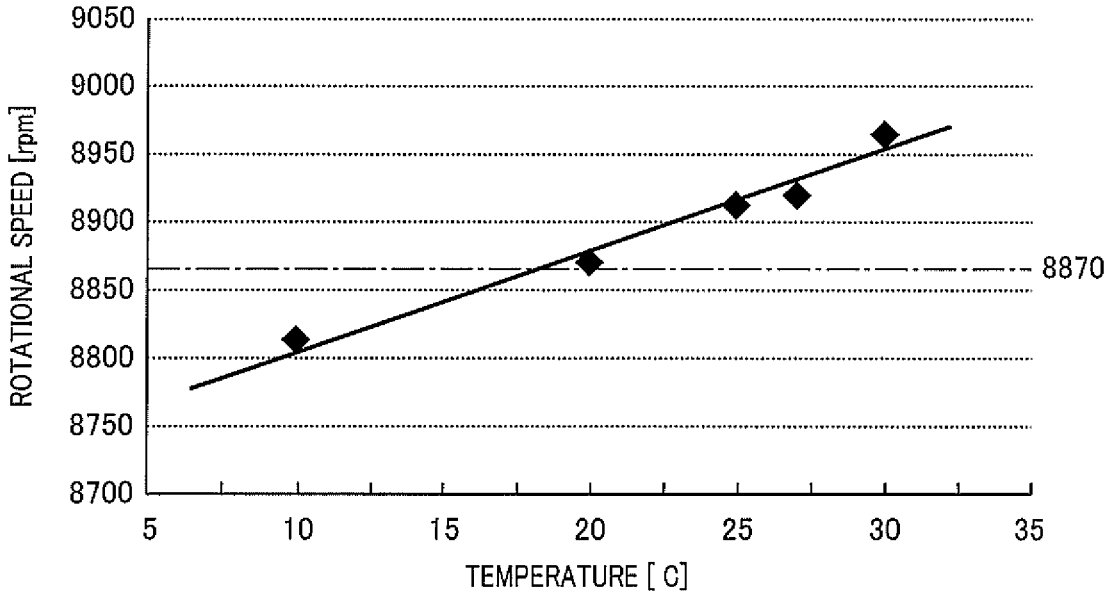
FIG. 8 is a diagram illustrating correspondence relation between the temperature, and the rotational speed of the fan.

FIG. 8 is a diagram illustrating correspondence relation between the temperature, and the rotational speed of the fan 300.

More specifically, FIG. 8 illustrates a measurement result of the rotational speed of the fan 300 in a case in which the temperature is changed under the conditions of humidity of 50%, and atmospheric pressure of 1002 hPa. In a range of the temperature illustrated in FIG. 8, the relation between the temperature, and the rotational speed of the fan 300 is approximated by a straight line (linear function).

The fan 300 is the fan in the new article state before the image formation is performed by the image forming apparatus 1.

As illustrated in FIG. 8, as the temperature is increased, the density of air is reduced with increase of the volume of air, and therefore the rotational speed of the fan 300 that drives at a predetermined voltage is increased with reduction of the rotation load.

Now, the influence of the humidity on the rotational speed of the fan 300 will be described with reference to FIG. 9.

Figure 9:
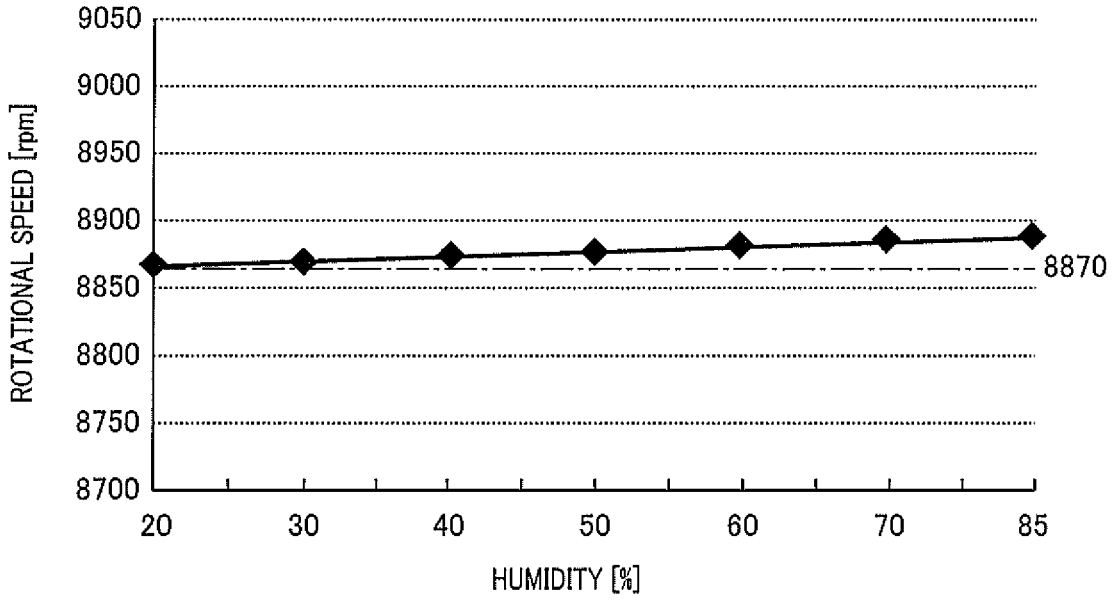
FIG. 9 is a diagram illustrating correspondence relation between the humidity, and the rotational speed of the fan.

FIG. 9 is a diagram illustrating correspondence relation between the humidity, and the rotational speed of the fan 300.

More specifically, FIG. 9 illustrates a measurement result of the rotational speed of the fan 300 in a case in which the humidity is changed under the conditions of a temperature of 20° C., and atmospheric pressure of 1002 hPa. In a range of the humidity illustrated in FIG. 9, the relation between the humidity, and the rotational speed of the fan 300 is approximated by a straight line (linear function).

The fan 300 is the fan in the new article state before the image formation is performed by the image forming apparatus 1.

As illustrated in FIG. 9, as the humidity is increased, the density of air is reduced with increase of the ratio of water molecules in the air (for example, reduction of the ratio of other component such as nitrogen molecules and oxygen molecules), and therefore the rotational speed of the fan 300 that drives at a predetermined voltage is increased with reduction of the rotation load.

Now, the influence of the atmospheric pressure on the rotational speed of the fan 300 will be described with reference to FIG. 10.

Figure 10:
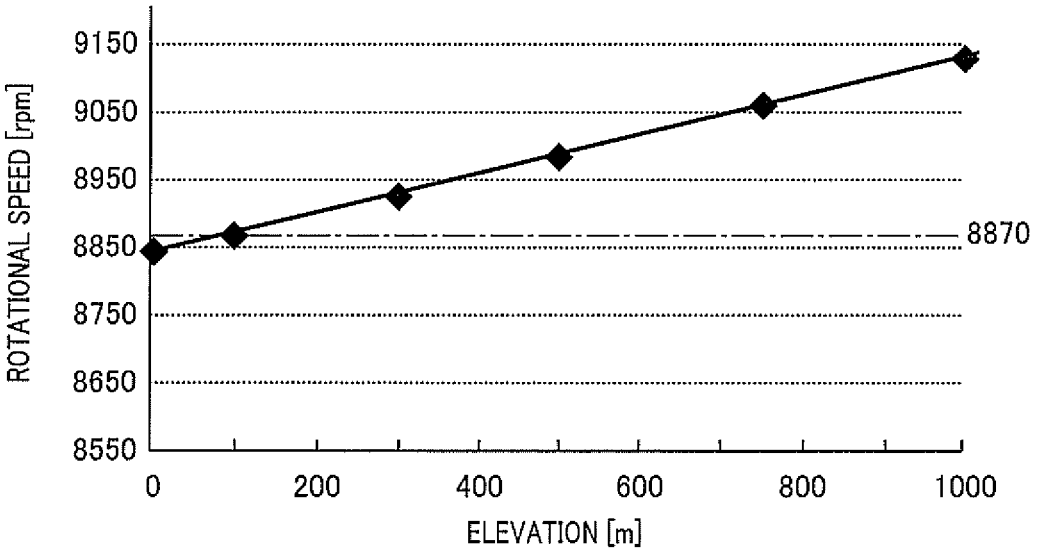
FIG. 10 is a diagram illustrating correspondence relation between an elevation, and the rotational speed of the fan.

Herein, the atmospheric pressure and the elevation have a correlation, and therefore correspondence relation between the elevation and the rotational speed of the fan 300 is illustrated in FIG. 10.

More specifically, FIG. 10 illustrates a measurement result of the rotational speed of the fan 300 in a case in which the elevation at a position at which the image forming apparatus 1 is installed is changed under the conditions of a temperature of 20° C., and humidity of 50%. In a range of the elevation illustrated in FIG. 10, the relation between the elevation, and the rotational speed of the fan 300 is approximated by a straight line (linear function).

The fan 300 is the fan in the new article state before the image formation is performed by the image forming apparatus 1.

As illustrated in FIG. 10, as the elevation is increased (atmospheric pressure is reduced), the density of air is reduced with increase of the volume of air, and therefore the rotational speed of the fan 300 that drives at a predetermined voltage is increased with reduction of the rotation load.

Thus, the density of air is changed in accordance with the change of the environmental condition such as the temperature, the atmospheric pressure, and the humidity, and influences the rotational speed of the fan 300, and therefore the environmental condition at the time of performing the image formation by the image forming apparatus 1 needs to be considered in order to detect the full state of the storage 103 from the change of the rotational speed of the fan 300.

The controller 50 corrects a measurement value of the measured rotational speed of the fan 300 based on the change of the environmental condition for performing the image formation, in accordance with a fan rotational speed correction program.

More specifically, the controller 50 corrects the measurement value of the rotational speed of the fan 300 based on at least one of changes of the temperature, the atmospheric pressure, and the humidity, as the environmental condition at the time of performing the image formation.

The controller 50 uses the reference rotational speed obtained by correcting the measurement value of the rotational speed of the fan 300 measured at the time of the installation of the image forming apparatus 1 to a value in a standard environment, as an initial state of the rotational speed of the fan 300. The standard environment is a predetermined environmental condition in order to remove the influence on the rotational speed of the fan 300 by the change of the environmental condition. The correction of the rotational speed based on the change of the environmental condition is to obtain a value equivalent to a rotational speed in the standard environment. The controller 50 detects the full state based on the change of the rotational speed of the fan 300 from the initial state (reference rotational speed).

The controller 50 does not necessarily use all the temperature, the atmospheric pressure, and the humidity as an environmental condition at the time of performing the image formation, but may correct the rotational speed of the fan 300 by using an environmental condition having a relatively large degree of influence on the change of the density of air among the temperature, the atmospheric pressure, and the humidity.

That is, the controller 50 selects an environmental condition having a relatively large inclination of an approximation straight line (for example, the temperature) as the environmental condition having a relatively large degree of influence on the change of the density of air, with reference to the correspondence relation between the rotational speed of the fan 300 and the temperature (refer to FIG. 8), the correspondence relation between the rotational speed of the fan 300 and the humidity (refer to FIG. 9), and the correspondence relation between the rotational speed of the fan 300 and the elevation (atmospheric pressure) (refer to FIG. 10). That is, in the inclination of an approximation straight line of each of the humidity, the atmospheric pressure, and the like that is relatively smaller than the inclination of the approximation straight line of the temperature, and a degree of influence on the change of the density of air is relatively small, and therefore it is considered that necessity of consideration of reduction of a calculation load is low.

Hereinafter, a method for easily correcting the rotational speed of the fan 300 by using the change of the temperature will be described as the environmental condition at the time of performing the image formation.

For example, the controller 50 sets a reference rotational speed at 20° C. to the rotational speed of the fan 300 (8870 [rpm]) in a new article state in a case in which the separation efficiency of the toner in the cyclone 102 is 98%. At this time, considering the elevation (atmospheric pressure) at a position where the image forming apparatus 1 is installed, the controller 50 may make adjustment such that the higher the elevation is (the lower the atmospheric pressure is), the faster the reference rotational speed is, for example.

The controller 50 corrects the rotational speed of the fan 300 detected based on a pulse signal output from the fan 300, in accordance with the following Expression (4). The rotational speed of the fan 300 after correction is denoted by reference symbol $\omega_0$. Herein, 20° C. is used as a reference temperature.

[Expression 4]

$$\omega_0 = C_T \times (20 - T) + e \qquad \text{Expression (4)}$$

where, reference symbol $C_T$ denotes a correction coefficient for a temperature, reference symbol T denotes the temperature, and reference symbol e denotes a rotational speed (measurement value) of the fan 300 before correction. The correction coefficient $C_T$ for a temperature is calculated based on the reference rotational speed at 20° C., the correspondence relation (refer to FIG. 8) between the rotational speed of the fan 300 and the temperature.

Similarly, the controller 50 may also calculate the correction coefficient C to be calculated in accordance with the aforementioned Expression (3), by using, for example, only the environmental condition having a relatively large degree of influence on the change of the density of air among the atmospheric pressure, and the humidity (for example, the atmospheric pressure). More specifically, the controller 50 calculates the correction coefficient C such that as the atmospheric pressure is increased, the value of the correction coefficient C is reduced, for example.

In the aforementioned full state detection process and duct clearance detection process, the rotational speed of the fan 300 corrected by the fan rotational speed correction process is desirably used.

More specifically, the controller 50 corrects the measurement value of the measured rotational speed of the fan 300, based on the change of the environmental condition of performing the image formation, and detects the full state in which the storage 103 is filled with toner, based on the rotational speed of the fan 300 after the correction. The controller 50 compares the rotational speed of the fan 300 after the correction with the initial state (reference rotational speed), and detects the full state in a case in which change from the initial state reaches a predetermined value or more. For example, in a case in which the rotational speed of the fan 300 after the correction is compared with the initial state to be increased by 1.1%, the controller 50 determines that the storage 103 is in the full state.

The controller 50 measures the rotational speed of the fan 300 a plurality of times, and corrects each measurement value based on the change of the environmental condition. The controller 50 calculates a variation rate from a plurality of the corrected rotational speeds of the fan 300, and issues a warning in a case in which the variation rate is a predetermined value or more. That is, in a case in which the variation rate of the corrected rotational speeds of the fan 300 is the predetermined value or more, the controller 50 issues a warning of a possibility of occurrence of a clearance in the duct 200.

Now, operation in the image forming apparatus 1 will be described.

Figure 11:
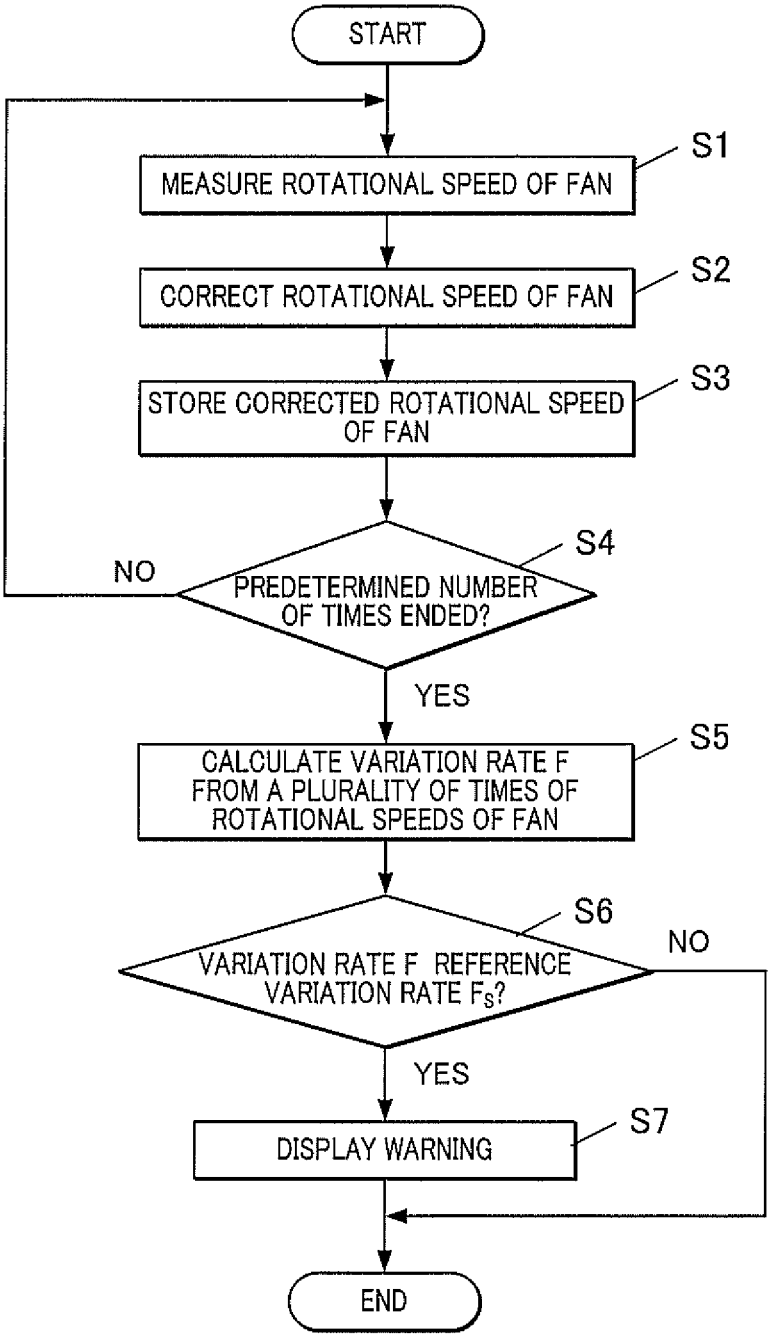
FIG. 11 is a flowchart illustrating a duct clearance detection process.

FIG. 11 is a flowchart illustrating the duct clearance detection process. This process is performed right after maintenance, at the time of turning on the image forming apparatus 1, at the time of end of printing (at the time of job end), or the like.

First, the controller 50 measures the rotational speed of the fan 300 based on a pulse signal output from the fan 300 (Step S1). The controller 50 measures the number of rotations of the fan 300 for a predetermined time or more in order to calculate the measurement value of the rotational speed of the fan 300.

Now, the controller 50 corrects the measurement value (measured value) of the measured rotational speed of the fan 300 based on the change of the environmental condition (Step S2). For example, the controller 50 makes a correction to convert the measurement value of the rotational speed obtained by the measurement into a rotational speed in the standard environment.

Then, the controller 50 stores the corrected rotational speed of the fan 300 in the memory 60 (Step S3).

Herein, the controller 50 determines whether or not the measurement of the rotational speed of the fan 300 is ended a predetermined number of times (for example, 6 times) (Step S4).

In a case in which the number of the measurements of the rotational speed of the fan 300 is less than the predetermined number of times (Step S4; NO), the process returns to Step S1 to be repeated.

In a case in which the measurement of the rotational speed of the fan 300 is ended the predetermined number of times in Step S4 (Step S4; YES), the controller 50 calculates the variation rate F from a plurality of times of the rotational speeds of the fan 300 (after correction) (Step S5). The variation rate F is obtained by the aforementioned Expression (1).

Then, the controller 50 determines whether or not the variation rate F is the reference variation rate $F_S$ or more (Step S6). The reference variation rate $F_S$ is a threshold value at the time of detecting that a clearance exists in the duct 200.

In a case in which the variation rate F is the reference variation rate $F_S$ or more (Step S6; YES), the controller 50 determines that a clearance exists in the duct 200, and displays the warning on the display section 71 (Step S7). For example, a message such as "A clearance exists in the duct. Please check it." is displayed on the display section 71. A method for issuing a warning is not limited to the display of a warning message, and may be to attract attention to a user or a service engineer by generating a buzzer sound.

In a case in which the variation rate F is less than the reference variation rate $F_S$ in Step S6 (Step S6; NO), or after Step S7, the duct clearance detection process is ended.

Herein, the rotational speed of the fan 300 is continuously measured the plurality of times, and the variation rate is obtained. However, the rotational speed of the fan 300 may be periodically measured, the variation rate may be obtained from data for last 6 times (N is a natural number large enough to obtain the variation rate), and a clearance in the duct 200 may be detected.

As described above, according to the image forming apparatus 1 of this embodiment, in a case in which the rotational speed of the fan 300 is measured the plurality of times, and the variation rate of the rotational speeds is the predetermined value or more, the warning is issued, and therefore attention can be attracted to a user or a service engineer in a case in which a component assembly state is abnormal, for example, in a case in which a clearance exists in the duct 200. When the warning is displayed on the display section 71, the user or the service engineer checks the assembly state of the duct 200 and the like, and corrects the position of each component. Consequently, the rotational speed of the fan 300 is stabilized, and therefore it is possible to prevent erroneous detection of the full state of the storage 103 that stores toner.

In particularly, like this embodiment, in a case in which the image forming apparatus 1 includes the duct 200 configured by connecting a plurality of the duct components 200*a*, 200*b*, 200*c*, a clearance easily occurs in the duct 200, and therefore detection of the clearance in the duct 200 is more important.

When the rotational speed of the fan 300 is measured, the measuring time is set to the predetermined time or more, so that measurement accuracy of the rotational speed of the fan 300 is improved.

The cyclone 102, the storage 103, and the filtering portion 105 are integrally formed, and are configured so as to be detachably attached to the apparatus body 1A of the image forming apparatus 1, and therefore, for example, in a case in which the storage 103 is brought into the full state, these cyclone 102, storage 103, and the filtering portion 105 are integrally replaceable, not only reduction of labor in replacement, and reduction of cost can be attained, but also scattering of toner stored in the storage 103 into the image forming apparatus 1 can be appropriately suppressed.

The rotational speed of the fan 300 is corrected based on the change of the environmental condition (for example, the temperature, the atmospheric pressure, and the humidity) for performing the image formation, and therefore even when the density of air that influences on the rotational speed of the fan 300 is changed, the rotational speed of the fan 300 can be appropriately corrected in consideration of the change of the density of air. In particularly, the rotational speed of the fan 300 can be appropriately corrected based on the change of the density of air that passes through the fan 300.

The full state in which the storage 103 is filled with toner is detected by use of the corrected rotational speed of the fan 300, so that the full state of the storage 103 can be detected with high accuracy before clogging of the filtering portion 105 occurs. Consequently, it is possible to suppress swirl-up of the toner in the storage 103 after the storage 103 is brought into the full state, and scattering of the toner into the image forming apparatus 1. The reference rotational speed obtained by correcting the measurement value of the rotational speed of the fan 300 measured at the time of installation of the image forming apparatus 1 to the value in the standard environment is used as the initial state of the rotational speed of the fan 300, so that influence by the change of the environmental condition from the rotational speed as a reference can be eliminated, and the full state can be accurately detected.

The clearance of the duct 200 is detected by use of the corrected rotational speed of the fan 300, and therefore abnormality can be accurately detected in a state in which the influence by the change of the environmental condition is eliminated.

The rotational speed $\omega_0$ of the fan 300 after correction can be calculated based on the correction coefficient $C_T$ for a temperature, the temperature T, and the rotational speed e of the fan 300 before correction by use of the aforementioned Expression (4). That is, as the environmental condition for performing the image formation, the rotational speed of the fan 300 can be corrected by use of the environmental condition having a relatively large degree of influence on the change of the density of air (for example, the temperature) among the temperature, the atmospheric pressure, and the humidity. Consequently, the rotational speed of the fan 300 can be simply corrected with the environmental condition having a relatively large degree of influence on the change of density of air as a reference. Furthermore, an environmental condition having a relatively small degree of influence on the change of the density of air is excluded, so that an arithmetic content is simplified, and a load can be reduced.

The present invention is not limited to the aforementioned embodiment, and various improvements and change of design may be performed without departing from the scope of the present invention.

In the aforementioned embodiment, the case in which the variation rate F is calculated by use of the standard deviation $\sigma$ and the average value A of the rotational speeds of the fan 300 obtained by a plurality of times of measurements (refer to the aforementioned Expression (1)) is described. However, the method for calculating the variation rate F is not limited to this.

For example, the controller 50 may calculate the variation rate by using a maximum value and a minimum value of the rotational speeds of the fan 300 measured a plurality of times. Also in this case, the controller 50 corrects the respective measurement values of the rotational speeds of the fan 300 measured the plurality of times, based on the change of the environmental condition, and extracts the maximum value and the minimum value from the rotational speeds after the correction. The controller 50 obtains the variation rate F of the rotational speeds of the fan 300 in accordance with the following Expression (5).

[Expression 5]

$$F = \left(\frac{\omega_{max}}{\omega_{min}} - 1\right) \times 100 \qquad \text{Expression (5)}$$

where reference symbol $\omega_{max}$ denotes a maximum value of the rotational speed after correction, and reference symbol $\omega_{min}$ denotes a minimum value of the rotational speed after correction.

In a case in which the calculated variation rate F is the reference variation rate $F_S$ or more, the controller 50 determines that a clearance exists in the duct 200, and displays a warning on the display section 71. The reference variation rate $F_S$ used herein does not need to be the same value as the value used in Step S6 of FIG. 11 (duct clearance detection process).

In this method, the variation rate F is calculated by use of only the maximum value and the minimum value of the rotational speeds (after correction) measured a plurality of times, and therefore a processing speed can be increased.

In the aforementioned embodiment, the case in which the fan 300 is disposed on the downstream side with respect to the duct component 200*c* located on the most downstream side in the plurality of duct components 200*a*, 200*b*, 200*c* is described. However, the fan 300 may be provided at a position corresponding to the duct component 200*c* located on the most downstream side, for example, in the duct component 200*c*.

When the rotational speeds of the fan 300 are corrected, a total rotating time obtained by summing rotating times of the fan 300 may be considered. The controller 50 corrects the measurement values of the rotational speeds of the fan 300 based on the total rotating time of the fan 300. The correction of the rotational speeds based on the total rotating time of the fan 300 is to obtain a value equivalent to such a rotational speed, in a case in which the fan 300 is in the new article state. For example, as the total rotating time of the fan 300 is increased, a bearing of a rotary shaft in the fan 300 wears, and the rotational speed of the fan 300 becomes slow. In order to correct the delayed amount of the rotational speeds, the controller 50 provides a correction coefficient which becomes larger as the total rotating time of the fan 300 is increased, a value obtained by multiplying each measurement value of the rotational speeds of the fan 300 by this correction coefficient is defined as the rotational speed after the correction.

The rotational speeds of the fan 300 may be corrected based on both the total rotating time of the fan 300, and the change of the environmental condition.

The change of the environmental condition used when the rotational speed of the fan 300 is corrected is not necessarily the change of the density of the air that passes through the fan 300. For example, the change may be the change of the density of air in the vicinity of the fan 300, may be the change of the density of air that passes through the suction ducts 36 or the common duct 37, or may be the change of the density of air inside or outside the image forming apparatus 1.

In the aforementioned embodiment, the arithmetic expression is used when the rotational speed of the fan 300 after correction is calculated. However, this is an example, and the present invention is not limited to this. For example, a table (not illustrated) in which the rotational speed of the fan 300 after correction is associated with the various environmental conditions such as the temperature, the atmospheric pressure, and the humidity may be used.

Furthermore, the configuration of the image forming apparatus 1 exemplified in the aforementioned embodiment is an example, and the present invention is not limited to this. For example, all the four image forming units 30Y, 30M, 30C, 30K are not necessarily mounted, and at least any one of the image forming units only needs to be mounted. In a case in which there is an image forming unit that is not used for image formation in the four image forming units 30Y, 30M, 30C, 30K, the suction duct 36 corresponding to the image forming unit which is not used may be sealed by a predetermined sealing member (not illustrated).

Furthermore, in the toner collector 100, the cyclone 102, the storage 103, and the filtering portion 105 may be separately formed. In this case, each of the cyclone 102, the storage 103, and the filtering portion 105 is individually replaceable.

In addition, in the aforementioned embodiment, a function of measuring the rotational speed, a function of detecting the full state, a function of issuing the warning, and a function of correcting the measurement value of the rotational speed are implemented by performing a predetermined program and the like by the CPU of the controller 50. However, these functions may be implemented by a predetermined logic circuit.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-116584, filed on Jun. 20, 2018, is incorporated herein by reference in its entirety.

What is claimed is:

1. An image forming apparatus comprising:

a cyclone which centrifugally separates toner from air containing the toner scattered;

a storage which stores the toner separated by the cyclone;

a filtering portion which allows air to pass, the air being obtained after the toner is separated by the cyclone;

a duct which guides the air that passes through the filtering portion;

a fan which generates a flow of the air to discharge the air that passes through the filtering portion; and a hardware processor which measures a rotational speed of the fan, detects a full state in which the storage is filled with the toner based on change of the rotational speed of the fan, and issues a warning in a case in which a variation rate of rotational speeds of the fan measured a plurality of times is a predetermined value or more.

2. The image forming apparatus according to claim 1, wherein the duct is configured by connecting a plurality of duct components.

3. The image forming apparatus according to claim 2, wherein the fan is disposed at a position corresponding to a duct component located on a most downstream side, or on a downstream side with respect to a duct component located on a most downstream side, in the plurality of duct components.

4. The image forming apparatus according to claim 1, wherein the hardware processor measures a number of times of rotations of the fan for a predetermined time or more to calculate the rotational speed of the fan.

5. The image forming apparatus according to claim 1, wherein the hardware processor calculates the variation rate by using a maximum value and a minimum value of the rotational speeds of the fan measured the plurality of times.

6. The image forming apparatus according to claim 1, wherein the cyclone, the storage, and the filtering portion are integrally formed, are configured so as to be detachably attached to a body of the image forming apparatus.

7. The image forming apparatus according to claim 1, wherein the hardware processor corrects a measurement value of the measured rotational speed of the fan, based on change of an environmental condition for performing image formation.

8. The image forming apparatus according to claim 7, wherein the environmental condition includes at least one of a temperature, atmospheric pressure, and humidity.

9. The image forming apparatus according to claim 8, wherein the temperature, the atmospheric pressure, and the humidity are a temperature, atmospheric pressure, and humidity of air that passes through the fan.

10. The image forming apparatus according to claim 7, wherein the hardware processor uses, as an initial state of the rotational speed of the fan, a reference rotational speed obtained by correcting a measurement value of a rotational speed of the fan measured at a time of installation of the image forming apparatus based on change of the environmental condition, and detects the full state based on the change of the rotational speed of the fan from the initial state.

11. The image forming apparatus according to claim 1, wherein the hardware processor corrects a measurement value of the measured rotational speed of the fan based on a total rotating time obtained by summing rotating times of the fan.

* * * * *